US011519358B2

(12) United States Patent
Martins et al.

(10) Patent No.: US 11,519,358 B2
(45) Date of Patent: Dec. 6, 2022

(54) TRI-WELD PISTON

(71) Applicant: Industrial Parts Depot, LLC, Torrance, CA (US)

(72) Inventors: Airton Martins, San Pedro, CA (US); Michael J. Badar, Santa Monica, CA (US); John Brooks, Long Beach, CA (US); T. Vince Barbarie, Redondo Beach, CA (US); Roberto Melena, Wilimington, CA (US); Steve Scott, Houston, TX (US)

(73) Assignee: Industrial Parts Depot, LLC, Torrance, CA (US)

( * ) Notice: Subject to any disclaimer, the term of this patent is extended or adjusted under 35 U.S.C. 154(b) by 0 days.

(21) Appl. No.: 17/474,954

(22) Filed: Sep. 14, 2021

(65) Prior Publication Data

US 2022/0136455 A1 May 5, 2022

Related U.S. Application Data

(60) Provisional application No. 63/110,198, filed on Nov. 5, 2020.

(51) Int. Cl.
*F02F 3/00* (2006.01)
*F02F 3/22* (2006.01)

(52) U.S. Cl.
CPC ..... *F02F 3/003* (2013.01); *F02F 3/22* (2013.01); *F02F 2003/0061* (2013.01)

(58) Field of Classification Search
CPC .. F02F 3/003; F02F 3/22; F02F 3/0015; F02F 2003/0061; F16J 1/005; B21K 1/18; B23P 15/10
See application file for complete search history.

(56) References Cited

U.S. PATENT DOCUMENTS 3,877,351 A * 4/1975 Barfiss ..... F02F 3/22 92/216
3,915,141 A * 10/1975 Ottl ..... F02B 23/0696 92/216
6,477,941 B1 * 11/2002 Zhu ..... F02F 3/003 92/186
6,513,477 B1 * 2/2003 Gaiser ..... F16J 1/08 123/193.6
6,763,758 B2 * 7/2004 Kemnitz ..... F02F 3/22 92/255
2010/0299922 A1 * 12/2010 Gniesmer ..... B23K 20/12 29/888.044

* cited by examiner

*Primary Examiner* — Grant Moubry
(74) *Attorney, Agent, or Firm* — Felix L. Fischer

(57) ABSTRACT

A diesel engine piston has a body and a crown engaged to the body with three inertially welded struts. The body includes a base extending downward opposite the crown with pin bosses having pin bores and a skirt extending downward from the base.

15 Claims, 8 Drawing Sheets

TRI-WELD PISTON

REFERENCE TO RELATED APPLICATIONS

This application claims priority of U.S. provisional application Ser. No. 63/110,198 filed on Nov. 5, 2020 entitled TRI-WELD PISTON, having a common assignee as the present application, the disclosure of which is incorporated herein by reference.

BACKGROUND INFORMATION

Field

Embodiments of the disclosure relate generally to combustion engine pistons and more particularly to a piston having a crown and body inertially welded at three circumferential lands.

Background

Modern diesel engines employ increasingly higher cylinder pressures. To accommodate those pressures and to provide adequate cooling, pistons for use in such engines require novel structural design.

SUMMARY

Embodiments disclosed herein provide a diesel engine piston having a body and a crown engaged to the body with three inertially welded struts. The body includes a base extending downward opposite the crown with pin bosses having pin bores and a skirt extending downward from the base.

The features, functions, and advantages that have been discussed can be achieved independently in various embodiments of the present disclosure or may be combined in yet other embodiments further details of which can be seen with reference to the following description and drawings.

BRIEF DESCRIPTION OF THE DRAWINGS

FIG. 5 is a section view along the pin bore axis of the example implementation after welding of the crown and body and machining;

DETAILED DESCRIPTION

Implementations disclosed herein provide a piston for diesel engines having a mated crown and body with three cylindrical struts joined with mating inertial weld lands providing a plurality of galleries for oil circulation. The inertial weld lands and galleries are positioned and sized for optimized structural strength with inertial welding.

Figure 1:
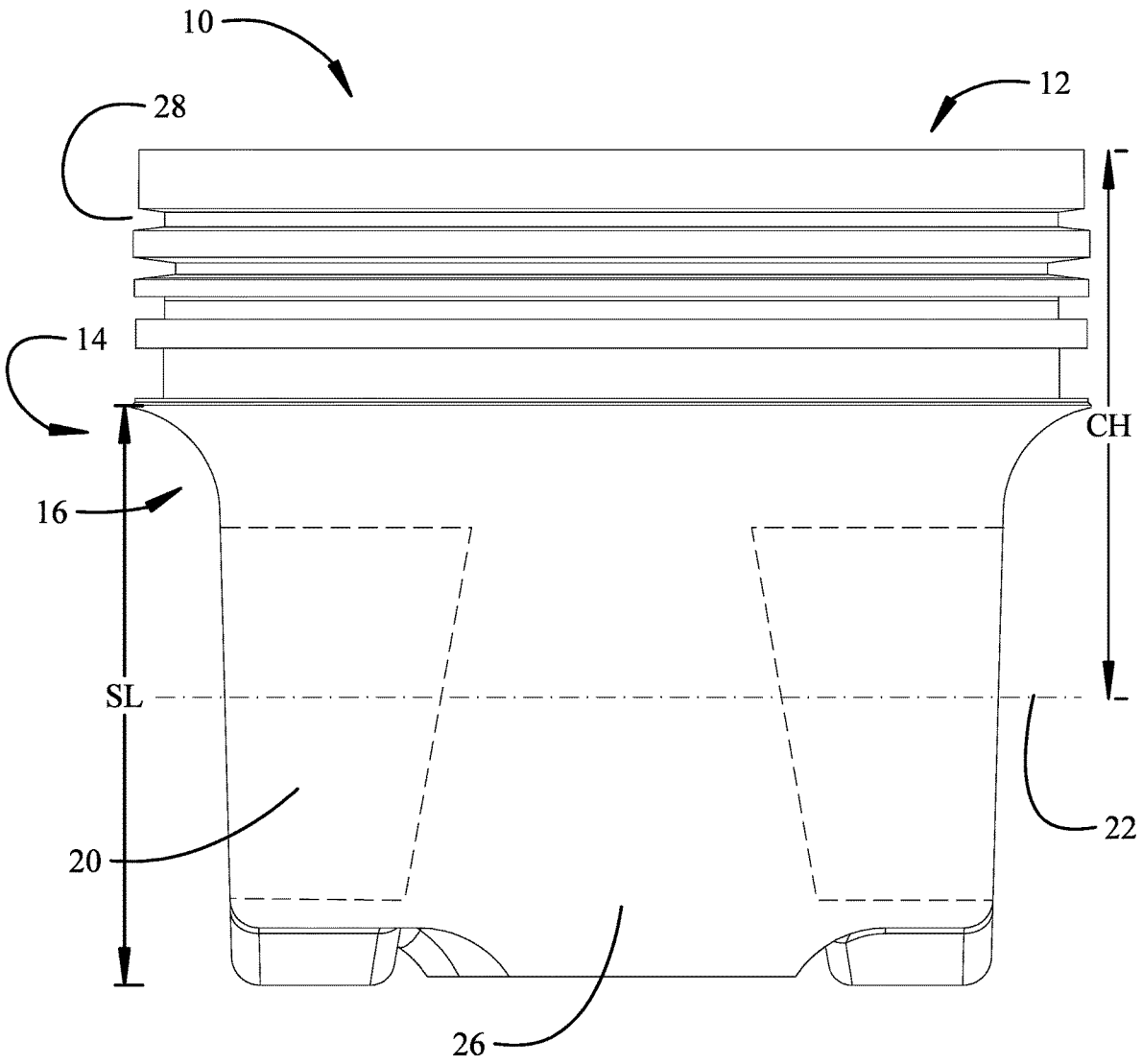
FIG. 1 is a side view perpendicular to a pin bore axis of an example implementation of a tri-weld piston.
Figure 2:
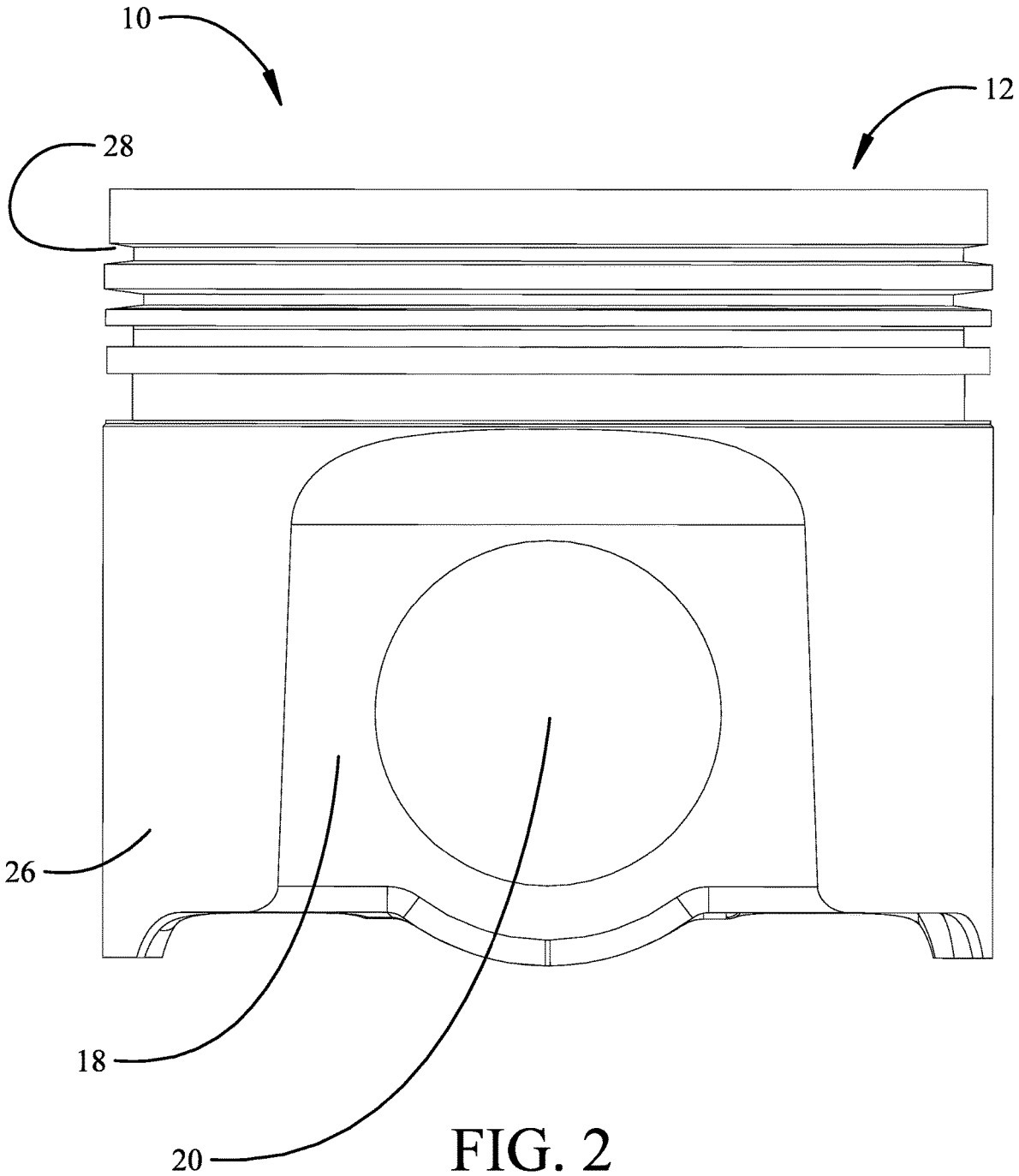
FIG. 2 is a front view along the pin bore axis of the example implementation.

Referring to the drawings, FIGS. 1 and 2 show an exemplary implementation of a tri-weld piston 10. The piston employs a crown 12 engaged to a body 14. The body 14 includes a base 16 extending downward opposite the crown 12 with pin bosses 18 having pin bores 20 to receive a wrist pin for engagement of the piston to a connecting rod extending from an engine crankshaft. Details of the wrist pin, connecting rod and crankshaft are conventional and not shown herein. A crown height CH from a pin bore axis 22 to a top periphery 24 of the crown defines the piston height. A skirt 26 also extends downward from the base 16 having a skirt length SL. Ring grooves 28 may be provided in both the crown and base, as is conventional in the art.

Figure 3:
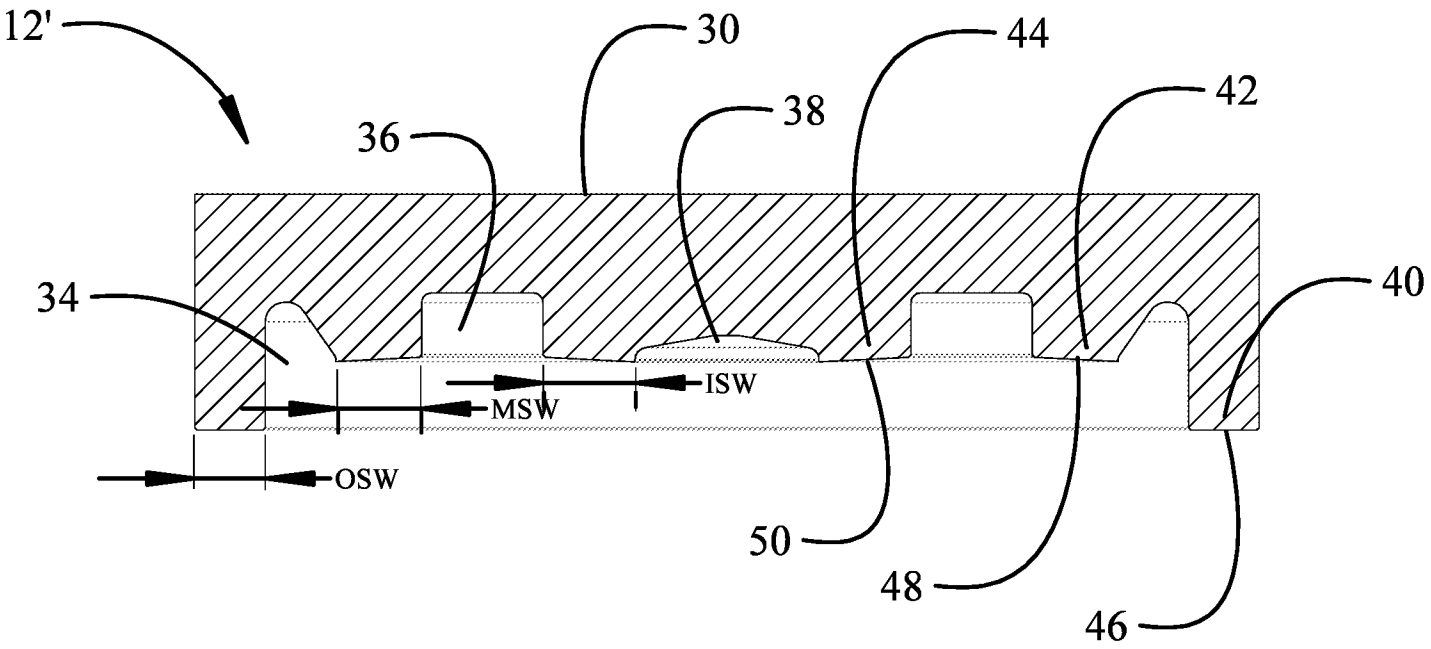
FIG. 3 is a section view of the crown in the tri-weld piston prior to inertial welding and machining.

As shown in FIG. 3, the tri-weld piston 10 may employ a straight top crown 12' having a flat upper surface 30 as a manufacturing intermediary. Alternatively an RT bowl crown providing a partially machined profiled bowl upper surface may be used as a manufacturing intermediary. The crown 12' includes a oil gallery cap 34 and weld cavity cap 36 and a central cavity cap 38. The oil gallery cap 34 is circumferentially bounded by an outer upper strut 40 and a middle upper strut 42 while the weld cavity cap 36 is circumferentially bounded by the middle upper strut 42 and an inner upper strut 44. The central cavity cap 28 is circumferentially bounded by the inner upper strut 44. To provide for inertial welding, the outer upper strut 40 terminates in an upper outer land 46, the middle upper strut 42 terminates in an upper middle land 48 and the inner upper strut 44 terminates in an upper inner land 50.

Figure 4:
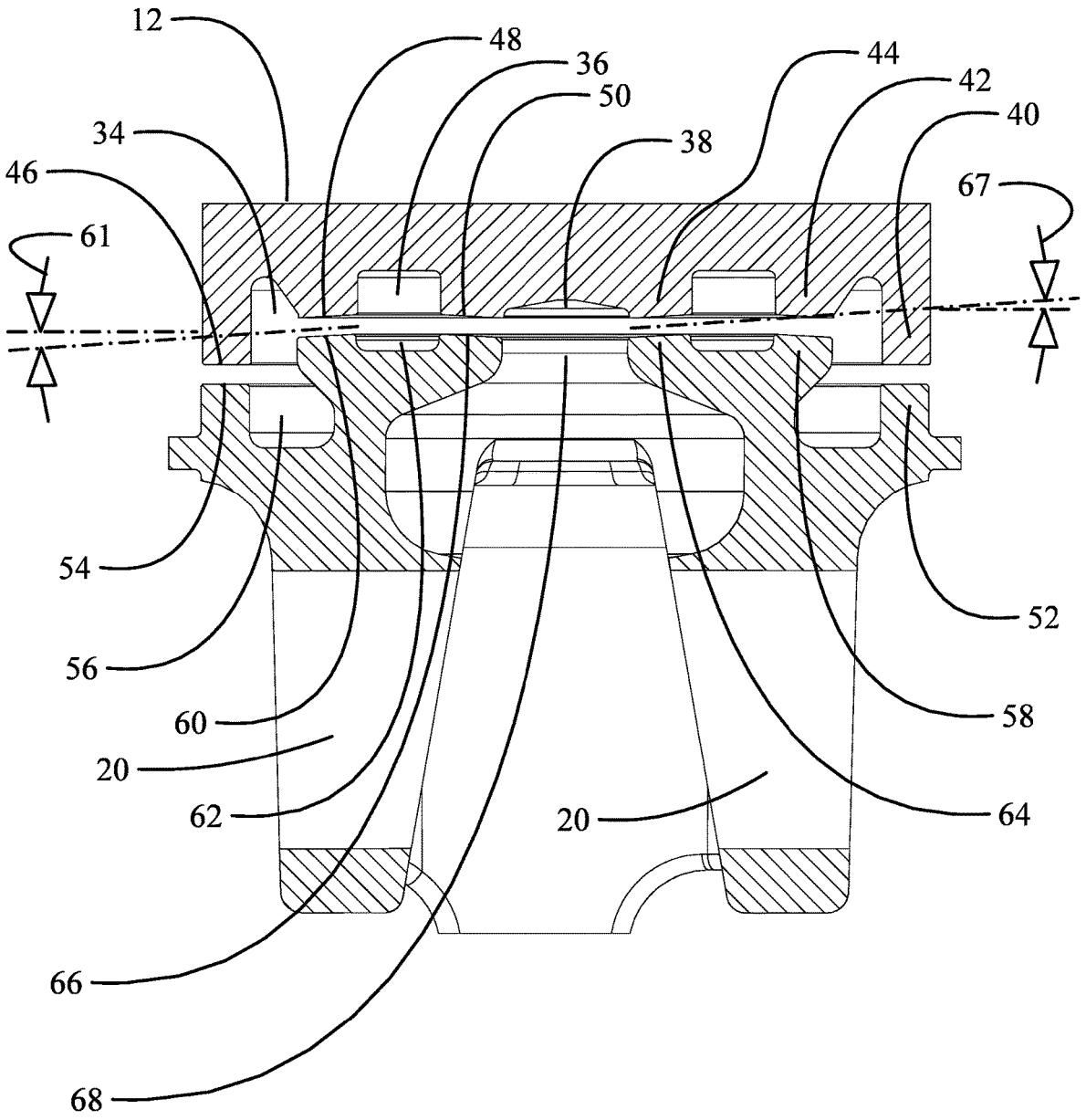
FIG. 4 is a section view perpendicular to the pin bore axis of the example implementation of the body of the tri-weld piston the crown shown aligned with but not welded to the body.

FIG. 4 shows the details in section view of the body 14 prior to welding of the crown. The base 16 includes mating struts with corresponding lands for engagement of the crown with the gallery caps in alignment with oil galleries in the base. An outer lower strut 52, having a lower outer land 54 in alignment with the upper outer land 46, circumferentially surrounds an oil gallery 56. Similarly, a middle lower strut 58, having a lower middle land 60 in alignment with the upper middle land 48, provides an inner circumferential bound for the oil gallery and an outer circumferential bound for a weld cavity 62. An inner lower strut 64, having a lower inner land 66 in alignment with the upper inner land 50, provides an inner circumferential bound for the weld cavity 62 and a wall for a central cavity 68 substantially concentric with an axis 23 of the piston.

Figure 5:
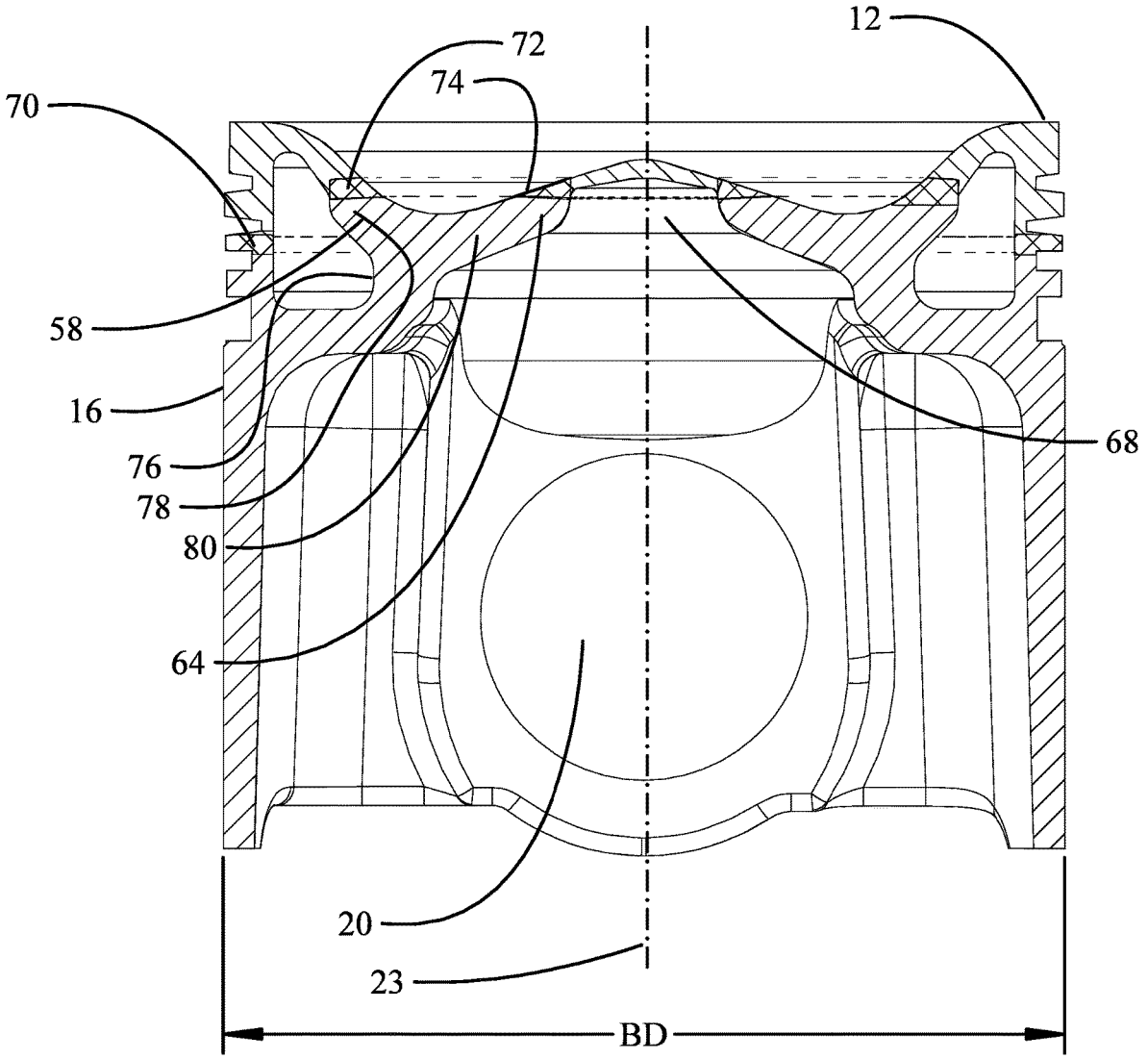
FIG. 5 is a section view along the bin bore axis after welding of the crown and body and machining.
Figure 6:
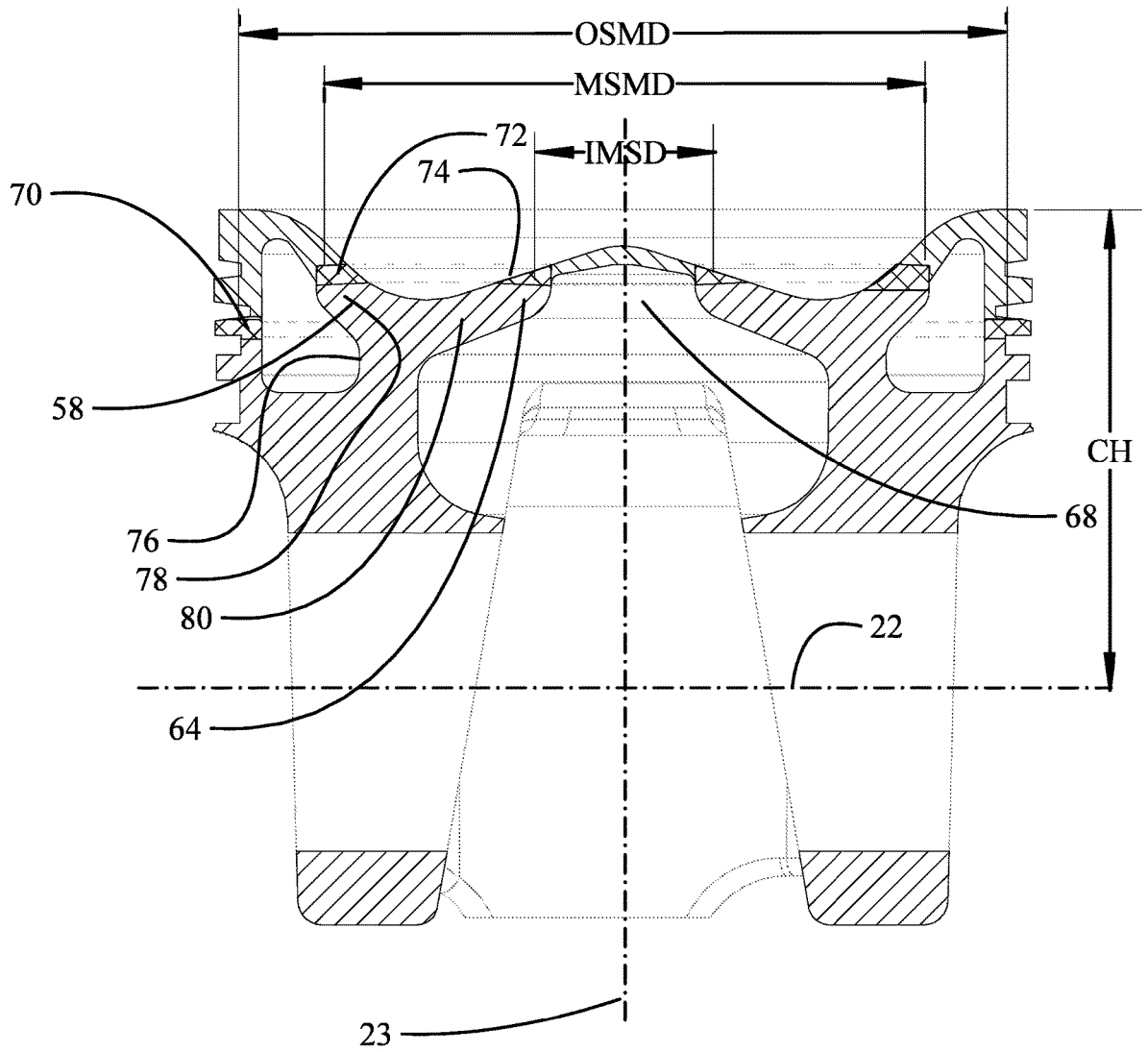
FIG. 6 is a section view of the first implementation perpendicular to the pin bore axis after welding of the crown and machining 1.

FIGS. 5 and 6 show the implementation after welding and machining. In the example implementation, the weld cavity cap 36 and weld cavity 62 are removed in profile machining of the upper surface of the crown.

The crown 12 is inertially welded to the base 16 engaging the outer upper and lower lands 46, 54, the middle upper and lower lands 48, 60 and the inner upper and lower lands 50, 66 forming an outer strut 70 from the outer upper and lower struts 40, 52, a middle strut 72 from the middle upper and lower struts 42, 58 and an inner strut 74 from the inner upper and lower struts 44, 64. The three cylindrical struts seal the oil gallery and central cavity and provide structural attachment of the crown to the base 16. In the example implementation, the middle upper and lower lands 48, 60 are angled from the horizontal by an angle 61. Similarly, the inner upper and lower lands 50, 66 are angled from the horizontal by an angle 67.

As seen in FIGS. 5 and 6, the oil gallery 56 incorporates a gallery relief 76 expanding the volume of the oil gallery and providing an outer contour for the middle lower strut 58 with a reduced thickness neck 78. The inner lower strut 64 is also contoured for the central galley 68 resulting in suspension of the inner lower strut 64 by a cantilever flange 80.

Positioning and size of the upper and lower struts and lands is optimized for desired structural strength. As seen in FIGS. 5 and 6, for the base 14 having a base diameter BD, reference dimensions for an outer strut median diameter OSMD, middle strut median diameter MSMD and an inner strut median diameter ISMD are established with an outer strut width OSW, middle strut width MSW and a inner strut width ISW at the corresponding lands (seen in FIG. 3). In exemplary implementations herein non-dimensionalized by the based diameter BD, ISMD as a percentage of BD equals 26.34%, OSMD as a percentage of BD equals 93.44%, MSMD as a percentage of BD equals 66.49%, CH as a percentage of BD equals 58.88%, SL as a percentage of BD equals 60.38%, ISW as a percentage of BD equals 8.79%, OSW as a percentage of BD equals 6.72%, MSW as a percentage of BD equals 8.22%.

Figure 7:
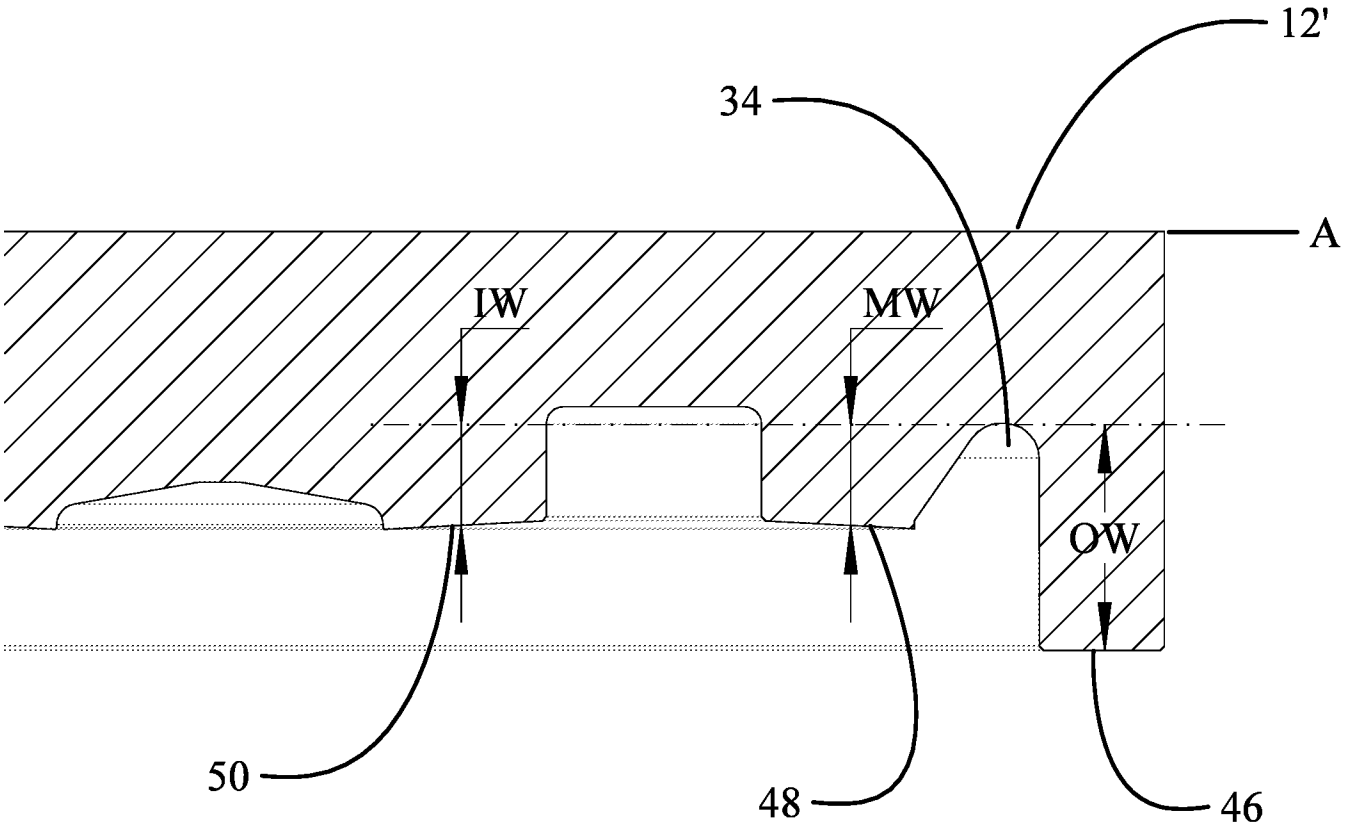
FIG. 7 is a detailed section view of the crown showing weld land stagger.

As seen in FIG. 7 in detail, the upper inner land 50, upper middle land 48 and upper outer land 46 are vertically staggered with complimentary staggering from a reference plane A of the inner lower land, middle lower land and outer lower land to provide relative positioning of the inertial welds are outer weld OW, middle weld MW and inner weld IW as seen in FIG. 6. Again non-dimensionalized by the base diameter BD, OW as a percentage of BD equals 11.02%, MW as a percentage of BD equals 4.48% and IW as a percentage of BD equals 4.51%. Additionally, the weld position may be characterized by relative position to the pin axis as determined by CH (as seen in FIG. 6) where IW to CH as a percentage of BD equals 50.82%.

For desired alternative dimensioning for implementations consistent with the disclosure herein, optimized ranges are:
ISMD as a percentage of BD equals 10.53-42.14%
OSMD as a percentage of BD equals 37.37-149.50%
MSMD as a percentage of BD equals 26.60-106.38%
CH as a percentage of BD equals 23.55-94.21%
SL as a percentage of BD equals 24.15-96.60%
ISW as a percentage of BD equals 3.52-14.07%
OSW as a percentage of BD equals 2.69-10.76%
MSW as a percentage of BD equals 3.29-13.15%
OW as a percentage of BD equals 4.41-17.63%
MW as a percentage of BD equals 1.79-7.17%
IW as a percentage of BD equals 1.80-7.22%
IW to CH as a percentage of BD equals 20.33-81.32%

Figure 8:
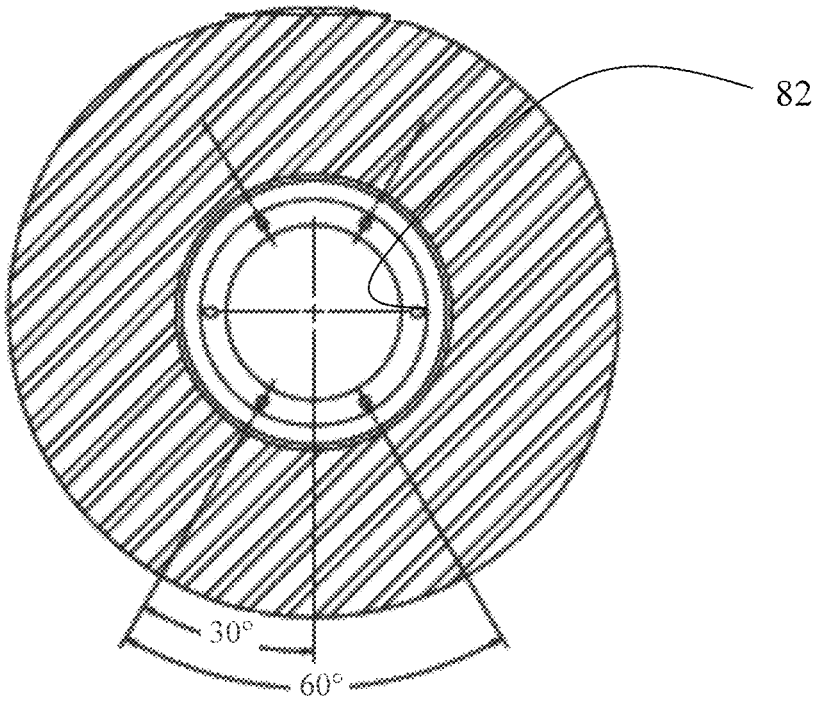
FIG. 8 is an upward section view through line 7-7 of FIG. 6 showing oil conduit inlets into the central cavity of the body; and, FIG. 9. Is a section view parallel to the bin bore axis of the body of the second implementation.
Figure 9:
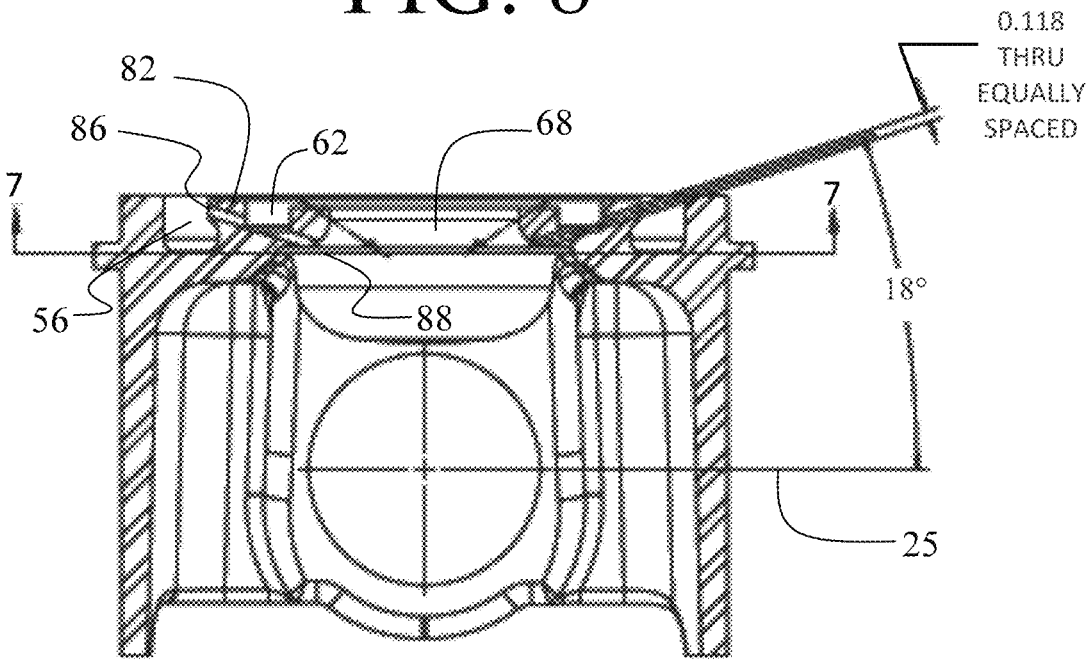

The implementations disclosed herein additionally incorporate a plurality of conduits 82 in the base 16 for fluid communication between the oil gallery 56 and central cavity 68 as seen in FIGS. 8 and 9. The conduits 82 in the example implementation are azimuthally spaced relative to the axis 23 of the piston at 60° intervals. The conduits 82 angularly descend at 15° relative to a plane 25 of the pin bore axis 22 perpendicular to the axis 23 from inlets 86 in the oil gallery 56 through the weld cavity 62 to outlets 88 in the central cavity 68.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims. As used herein the terms "upward", "downward" are employed to signify relative position in relationship to the geometry of the drawings of the implementations herein and may be substituted with "inboard" and "outboard", "first direction" and "second direction", "right" and "left" or other adjective based on the geometry of the associated implementation. The term "substantially" as used within the specification and claims means that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

What is claimed is:

1. A diesel engine piston comprising:
a body;
a crown engaged to the body with three inertially welded struts comprising
an outer upper strut terminating in an upper outer land,
a middle upper strut terminating in an upper middle land,
and an inner upper strut terminating in an upper inner land;
the body further comprising
an outer lower strut circumferentially surrounding an oil gallery and having a lower outer land in alignment with the upper outer land and,
a middle lower strut providing and inner circumferential bound for the oil gallery and outer circumferential bound for a weld cavity and having a lower middle land in alignment with the upper middle land, and,
an inner lower strut providing an inner circumferential bound for the weld cavity and a wall for central cavity and having a lower inner land in alignment with the upper inner land,
wherein, the upper outer land and lower outer land, upper middle land and lower middle land, and upper inner land and lower inner land are inertially welded
and the body including
a base extending downward opposite the crown with pin bosses having pin bores and
a skirt extending downward from the base;
an oil gallery cap is circumferentially bounded by the outer upper strut and the middle upper strut,
a weld cavity cap is circumferentially bounded by the middle upper strut and an inner upper strut, and
a central cavity cap is circumferentially bounded by the inner upper strut;
wherein
inner strut median diameter (ISMD) as a percentage of base diameter (BD) equals 10.53-42.14%,
outer strut median diameter (OSMD) as a percentage of BD equals 37.37-149.50%, and middle strut median diameter (MSMD) as a percentage of BD equals 26.60-106.38%.

2. The diesel engine piston as defined in claim 1 wherein
crown height (CH) as a percentage of BD equals 23.55-94.21%
skirt length (SL) as a percentage of BD equals 24.15-96.60%
inner skirt width (ISW) as a percentage of BD equals 3.52-14.07% outer skirt width (OSW) as a percentage of BD equals 2.69-10.76% middle skirt width (MSW) as a percentage of BD equals 3.29-13.15% outer weld (OW) as a percentage of BD equals 4.41-17.63% middle weld (MW) as a percentage of BD equals 1.79-7.17% and inner weld (IW) as a percentage of BD equals 1.80-7.22%.

3. The diesel engine piston as defined in claim 1 wherein a plurality of conduits in the base provide fluid communication between the oil gallery and central cavity.

4. The diesel engine piston as defined in claim 3 wherein the plurality of conduits are azimuthally azimuthally spaced relative to an axis of the piston at 60° intervals and the plurality of conduits angularly descend at 15° relative to a pin bore axis from inlets in the oil gallery through the weld cavity to outlets in the central cavity.

5. The diesel engine piston as defined in claim 1 wherein the oil gallery incorporates a galley relief expanding a volume of the oil gallery and providing an outer contour for the middle lower strut with a reduced thickness neck and the inner lower strut is contoured for the central cavity, the inner lower strut suspended by a cantilever flange.

6. A diesel engine piston comprising:

a body;

a crown engaged to the body with three inertially welded struts comprising an outer upper strut terminating in an upper outer land, a middle upper strut terminating in an upper middle land, and an inner upper strut terminating in an upper inner land;

the body further comprising an outer lower strut circumferentially surrounding an oil gallery and having a lower outer land in alignment with the upper outer land and, a middle lower strut providing an inner circumferential bound for the oil gallery and an outer circumferential bound for a weld cavity and having a lower middle land in alignment with the upper middle land, and, an inner lower strut providing an inner circumferential bound for the weld cavity and a wall for a central cavity and having a lower inner land in alignment with the upper inner land, wherein, the upper outer land and lower outer land, upper middle land and lower middle land, and upper land and lower inner land are inertially welded and the body including a base extending downward opposite the crown with pin bosses having pin bores and a skirt extending downward from the base;

an oil gallery cap is circumferentially bounded by the outer upper strut and the middle upper strut, a weld cavity cap is circumferentially bounded by the middle upper strut and the inner upper strut, and a central cavity cap is circumferentially bounded by the inner upper strut; wherein inner strut width (ISW) as a percentage of base diameter (BD) equals 3.52-14.07%, outer strut width (OSW) as a percentage of BD equals 2.69-10.76%, and middle strut width (MSW) as a percentage of BD equals 3.29-13.15%.

7. The diesel engine piston as defined in claim 6 wherein a plurality of conduits in the base provide fluid communication between the oil gallery and central cavity.

8. The diesel engine piston as defined in claim 7 wherein the plurality of conduits are azimuthally spaced relative to an axis of the piston at 60° intervals and the plurality of conduits angularly descend at 15° relative to a pin bore axis from inlets in the oil gallery through the weld cavity to outlets in the central cavity.

9. The diesel engine piston as defined in claim 6 wherein the oil gallery incorporates a gallery relief expanding a volume of the oil gallery and providing an outer contour for the middle lower strut with a reduced thickness neck and the inner lower strut is contoured for the central cavity, the inner lower strut suspended by a cantilever flange.

10. The diesel engine as defined in claim 6 wherein inner strut median diameter (ISMD) as a percentage of base diameter (BD) equals 10.53-42.14%, outer strut median diameter (OSMD) as a percentage of BD equals 37.37-149.50%, and middle strut median diameter (MSMD) as a percentage of BD equals 26.60-106.38%, crown height (CH) as a percentage of BD equals 23.55-94.21% skirt length (SL) as a percentage of BD equals 24.15-96.60% outer weld (OW) as a percentage of BD equals 4.41-17.63% middle weld (MW) as a percentage of BD equals 1.79-7.17% and inner weld (IW) as a percentage of BD equals 1.80-7.22%.

11. A diesel engine piston comprising:

a body;

a crown engaged to the body with three inertially welding struts comprising an outer upper strut terminating in an upper outer land, a middle upper strut terminating in an upper middle land, and an inner upper strut terminating in an upper inner land;

the body further comprising an outer lower strut circumferentially surrounding an oil gallery and having a lower outer land in alignment with the upper outer land and, a middle lower strut providing an inner circumferential bound for the oil gallery and an outer circumferential bound for a weld cavity and having a lower middle land in alignment with the upper middle land, and, an inner lower strut providing an inner circumferential bound for the weld cavity and a wall for a central cavity and having lower inner land in alignment with the upper inner land, wherein, the upper outer land and lower outer land, upper middle land and lower middle land, and upper inner land and lower inner land are inertially welded and the body including a base extending downward opposite the crown with pin bosses having pin bores and a skirt extending downward from the base;

an oil gallery cap is circumferentially bounded by the outer upper strut and the middle upper strut, a weld cavity cap is circumferentially bounded by the middle upper strut and the inner upper strut, and a central cavity cap is circumferentially bounded by the inner upper strut; wherein outer weld (OW) as a percentage of base diameter (BD) equals 4.41-17.63%, middle weld (MW) as a percentage of BD equals 1.79-7.17%, and inner weld (IW) as a percentage of BD equals 1.80-7.22%.

12. The diesel engine piston as defined in claim 11 wherein a plurality of conduits in the base provide fluid communication between the oil gallery and central cavity.

13. The diesel engine piston as defined in claim 12 wherein the plurality of conduits are azimuthally spaced relative to an axis of the piston at 60° intervals and the plurality of conduits angularly descend at 15° relative to a pin bore axis from inlets in the oil gallery through the weld cavity to outlets in the central cavity.

14. The diesel engine piston as defined in claim 11 wherein the oil gallery incorporates a gallery relief expanding a volume of the oil gallery and providing an outer contour for the middle lower strut with a reduced thickness neck and the inner lower strut is contoured for the central cavity, the inner lower strut suspended by a cantilever flange.

15. The diesel engine as defined in claim 11 wherein inner strut median diameter (ISMD) as a percentage of base diameter (BD) equals 10.53-42.14%, outer strut median diameter (OSMD) as a percentage of BD equals 37.37-149.50%, and middle strut median diameter (MSMD) as a percentage of BD equals 26.60-106.38%, crown height (CH) as a percentage of BD equals 23.55-94.21% skirt length (SL) as a percentage of BD equals 24.15-96.60% inner skirt width (ISW) as a percentage of BD equals 3.52-14.07% outer skirt width (OSW) as a percentage of BD equals 2.69-10.76% and middle skirt width (MSW) as a percentage of BD equals 3.29-13.15%.

* * * * *